US008900383B2

(12) United States Patent
Ohno

(10) Patent No.: US 8,900,383 B2
(45) Date of Patent: Dec. 2, 2014

(54) METHOD OF PRODUCING A HIGH TENACITY METAL WIRE MATERIAL

(75) Inventor: Yoshiaki Ohno, Nasushiobara (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 13/059,588

(22) PCT Filed: Aug. 5, 2009

(86) PCT No.: PCT/JP2009/063892

§ 371 (c)(1),
(2), (4) Date: Feb. 17, 2011

(87) PCT Pub. No.: WO2010/021244

PCT Pub. Date: Feb. 25, 2010

(65) Prior Publication Data

US 2011/0146849 A1 Jun. 23, 2011

(30) Foreign Application Priority Data

Aug. 20, 2008 (JP) ..... 2008-212076

(51) Int. Cl.

| | |
|---|---|
| ***C21D 9/52*** | (2006.01) |
| ***C22C 38/00*** | (2006.01) |
| ***C21D 8/06*** | (2006.01) |
| ***C21D 1/74*** | (2006.01) |
| ***C21D 1/32*** | (2006.01) |

(52) U.S. Cl.

CPC ..... *C22C 38/00* (2013.01); *C21D 9/525* (2013.01); *C21D 8/065* (2013.01); *C21D 1/74* (2013.01); *C21D 1/32* (2013.01)

USPC ..... 148/503; 148/595

(58) Field of Classification Search

CPC ..... C21D 9/525

USPC ..... 148/503, 595–600

See application file for complete search history.

(56) References Cited

U.S. PATENT DOCUMENTS

| | | | | |
|---|---|---|---|---|
| 6,823,706 | B1 * | 11/2004 | Kaneko et al. | 72/278 |
| 7,258,756 | B2 | 8/2007 | Nagao et al. | |

FOREIGN PATENT DOCUMENTS

| | | | |
|---|---|---|---|
| JP | 4-346619 | A | 12/1992 |
| JP | 6-299252 | A | 10/1994 |
| JP | 09-228274 | | 9/1997 |
| JP | 10-287955 | A | 10/1998 |
| JP | 11-269557 | | 10/1999 |
| JP | 2000-080441 | | 3/2000 |
| JP | 2001-512191 | A | 8/2001 |
| JP | 2005-126765 | A | 5/2005 |

(Continued)

OTHER PUBLICATIONS

Notice of Reasons for Refusal issued by the Japanese Patent Office in patent application No. 2010-525655 dated Sep. 3, 2013.

*Primary Examiner* — Brian Walck

(74) *Attorney, Agent, or Firm* — Sughrue Mion, PLLC

(57) ABSTRACT

A method of producing a high tenacity metal wire material having improved bending and torsional properties as well as high toughness and excellent fatigue resistance is provided without losing tenacity and elongation property. In the method, when a heat treatment is performed at a temperature range of 90-300° C. on a metal wire material of high-carbon steel containing 0.5-1.1% by mass of carbon atoms and having a processing strain of 2.5 or greater and tensile strength of 3,000 MPa or greater, a relationship between heat treatment time t(s) and heat treatment temperature T(K) at said temperature range represented by the equation: $0.1 \leq Ln(t) - 10100/T + 20 \leq 11$ is satisfied.

6 Claims, 1 Drawing Sheet

(56) References Cited

FOREIGN PATENT DOCUMENTS

| | | | |
|---|---|---|---|
| JP | 3983218 | B2 | 9/2007 |
| JP | 2008-038199 | | 2/2008 |
| JP | 2008-208450 | A | 9/2008 |
| WO | 99/06628 | A1 | 2/1999 |

* cited by examiner

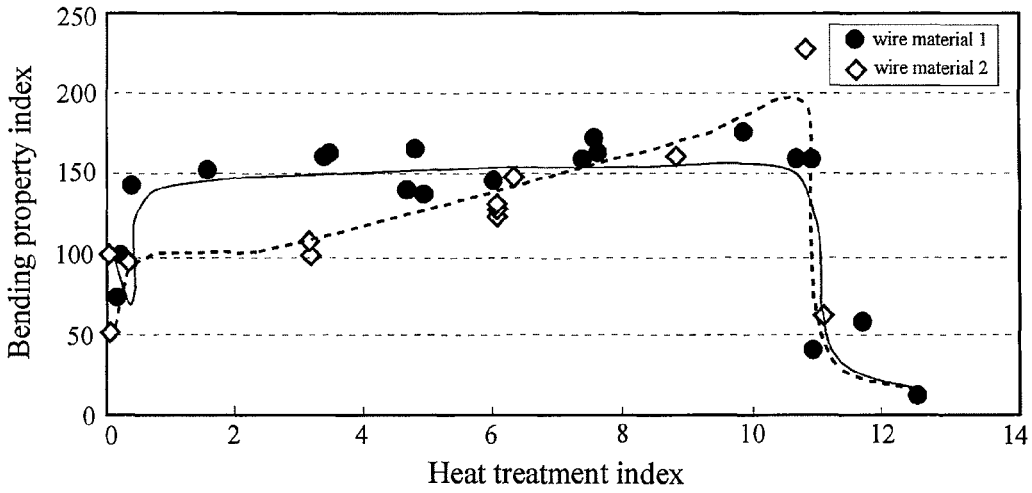
250
200
150
100
50
0
Bending property index
0
2
4
6
8
10
12
14
Heat treatment index
wire material 1
wire material 2

METHOD OF PRODUCING A HIGH TENACITY METAL WIRE MATERIAL

CROSS REFERENCE TO RELATED APPLICATION

This application is a National Stage of International Application No. PCT/JP2009/063892 filed Aug. 5, 2009, claiming priority based on Japanese Patent Applications No. 2008-212076, filed Aug. 20, 2008, the contents of all of which are incorporated herein by reference in their entirety.

TECHNICAL FIELD

The present invention relates to a method of producing a high tenacity metal wire material, particularly a method of producing a high tenacity metal wire material, in which a metal wire material having improved bending and torsional properties as well as high toughness and excellent fatigue resistance can be obtained without losing tenacity and elongation property.

BACKGROUND ART

Various properties are required for a metal wire used as a cord component. For example, from the viewpoint of recent environmental problems, it is particularly essential to reduce the weight of tires which contribute to increase in fuel-efficiency in automobiles. For this purpose, it is necessary that a cord used as reinforcement of a tire be highly strengthened so as to reduce the amount of use thereof.

As a method of highly strengthening a cord, it is useful to highly strengthen the wire per se which constitutes the cord. In this strengthening of wire, the composition thereof has been adjusted and/or drawing has been worked out for a metal wire material which is the starting material for a wire obtained by drawing. This has achieved to highly strengthen a cord; however, it is also a problem that the ductility of the metal wire material decreases with strengthening.

Conventionally, as a means for recovering the ductility of a metal wire material, it is common that a heat treatment at a low temperature for a short period of time, so-called bluing treatment, is performed on the metal wire material. It is tried to recover the ductility by this bluing treatment on the metal wire material.

In Patent Documents 1 and 2, for example, it was reported that the breaking elongation of the steel cord can be increased by performing a bluing treatment at a temperature range of around 400° C. for a certain retention time on a steel cord having the tensile strength of not more than 3,000 MPa.

Further, Patent Document 3 reported that the elastic elongation can be increased by performing a drawing treatment, plating treatment, and bluing treatment at a temperature range between 340° C. and 500° C. for several seconds to several tens of seconds on a steel wire.

Further, in Patent Document 4, it was reported that the ductility may be increased by performing a bluing treatment in which the retention time is adjusted to between 6 seconds and 15 minutes at a temperature range between 250° C. and 440° C. on a carbon steel wire to control the maximum value of internal friction of the carbon steel wire to within a suitable range at a temperature range between 180° C. and 220° C.

Moreover, in Patent Document 5, a correlation between the existence of an exothermic peak around 100° C. and the occurrence of delamination in torsional deformation of extra-fine high-carbon steel wire was discovered based on the analytical results of differential scanning calorimeter curve for extra-fine high-carbon steel wire and it was disclosed that decrease in ductility of strain aging (C diffusion-induced) can be suppressed by processing at a low temperature in a drawing process.

Furthermore, in Patent Document 6, it was reported that, when a heat treatment is performed at a temperature range of 250-400° C. on a metal wire material having a tensile strength of 4,000 MPa or greater, the ductility can be recovered without losing the tensile strength and bending strength of the metal wire material after the heat treatment by controlling the retention time at a temperature range so that the Fe diffusion length is within a prescribed range for the metal wire material after a heat treatment.

RELATED ART REFERENCE

Patent Documents

Patent Document 1: Japanese Unexamined Patent Application Publication No. H9-228274
Patent Document 2: Japanese Unexamined Patent Application Publication No. 2001-512191
Patent Document 3: Japanese Unexamined Patent Application Publication No. 2000-80441
Patent Document 4: Japanese Unexamined Patent Application Publication No. H11-269557
Patent Document 5: Japanese Patent No. 3983218
Patent Document 6: Japanese Unexamined Patent Application Publication No. 2008-38199

DISCLOSURE OF THE INVENTION

Problems to be Solved by the Invention

In the above-described various heat treatment methods which have been employed as means for recovering the ductility of metal wire material and the like, there have been problems in that, although breaking elongation is largely recovered, the strength decreases greatly and the bending strength property also decreases due to spheroidization of cementite. On the other hand, in steel materials obtained by a cold processing method, the above-described strain aging progresses when left at room temperature or during a heat treatment in manufacture of a tire such as a steel cord, and ultimately, the ductility and fatigue resistance are decreased.

Therefore, an object of the present invention is to provide a method of producing a high tenacity metal wire material, in which a metal wire material having improved bending and torsional properties as well as high toughness and excellent fatigue resistance can be obtained without losing tenacity and elongation properties.

Means for Solving the Problems

In order to solve the above-described problems, a method of producing a high tenacity metal wire material according to the present invention is related to a method, when a heat treatment is performed at a temperature range of 90-300° C., on a metal wire material of high-carbon steel containing 0.5-1.1% by mass of carbon atoms and having a processing strain of 2.5 or greater and tensile strength of 3,000 MPa or greater, satisfies a relationship between the heat treatment time t(s) and heat treatment temperature T(K) at the above-described temperature range represented by the following equation:

$$0.1 \leq \mathrm{Ln}(t) - 10100/T + 20 \leq 11 \quad (1).$$

In the present invention, it is preferred that a strain aging relaxation treatment be carried out prior to the above-described heat treatment, and further, it is preferred that the above-described heat treatment be carried out in a vacuum or inert gas.

The present invention was completed based on the following findings.

It is known that various strengthening mechanisms are employed in the strength of a steel cord, mainly for example, precipitation strengthening by a two-phased structure (pearlite structure) of ferrite and cementite, micro-strengthening by processing, process strengthening by accumulation of processing strains, and strain aging in which C and N atoms dissolved in ferrite adhere to dislocation.

In view of this, intensive studies were conducted on how these strengthening mechanisms change with heat based on thermal analysis of a wire using a differential scanning calorimeter, and also, on the strength and bending strength of the wire subjected to a heat treatment at respective temperatures.

First, based on the obtained peaks, it was discovered that there are three exothermic reactions; at 90° C. (the first reaction), 90-250° C. (the second reaction), and 250-400° C. (the third reaction).

Moreover, the followings were discovered based on the strength and bending strength of the wire subjected to a heat treatment within each reaction zone.

(The First Reaction)

This reaction is the strain aging (C, N diffusion-induced) reaction described in Japanese Patent No. 3983218 (Patent Document 5) and the strength increases while the bending strength decreases. This reaction also occurs at around room temperature during a drawing process.

(The Second Reaction)

The strength decreased slightly; however, the bending strength significantly increased. As there was no significant change in the metal structure, it is believed that this phenomenon in which the first reaction and process strengthening are relaxed was caused by, for example, carbide generation or relaxation by migration of strains (Recovery phenomenon)

(The Third Reaction)

Both the strength and bending strength decreased significantly. The metal structure was also disrupted, suggesting that the significant decrease in the strength and bending strength was induced by structural change.

Thus, the present inventor focused attention on the second reaction among those reactions, and since it is believed that proceeding of the reaction is controlled by diffusion of atoms, the coefficient was derived from the diffusion length of atoms, X, in the general equation in the below:

$$X=\sqrt{(2\times D\times t)}$$

$$D=DO\times E\times P(-Q/RT)$$

t: retention time (s)
T: temperature (K)
R: gas constant
Q: activation energy (kJ/mol)
DO: diffusion coefficient.

From the equation in the above, the coefficient was calculated and processed using temperature T and retention time t in a suitable heat treatment range, to derive the following equation:

$$0.1\leq \mathrm{Ln}(t)-10100/T+20\leq 11,$$

thereby completing the present invention.

Effects of the Invention

According to the present invention, there can be produced a high tenacity metal wire material having improved bending and torsional properties as well as high toughness and excellent fatigue resistance without losing tenacity and elongation property.

BRIEF DESCRIPTION OF THE DRAWING

FIG. 1 is a graph showing the relationship between the heat treatment indices and bending property indices in Examples.

MODE FOR CARRYING OUT THE INVENTION

Hereinafter, embodiments of the present invention will be specifically explained. In the present invention, a heat treatment is performed on a high-carbon steel containing 0.5-1.1% by mass of carbon atoms and having a pearlite structure. It has been confirmed that, in the high-carbon steel having the carbon atom content at an amount of the above-described range, cementite in the pearlite decomposes by a processing and the carbon content in ferrite contributing to the ductility increases, so that strain aging (adhesion of carbon atoms to strain) is facilitated and the ductility becomes decreased. This strain is relaxed by a heat treatment at 90-300° C., thus the ductility can be favorably improved.

Further, in the present invention, the processing strain of high-carbon steel is 2.5 or greater, preferably 3 or greater. It has been confirmed that the above-described cementite decomposition is facilitated in high-carbon steels having the processing strain of 2.5 or greater. Particularly, the decomposition becomes prominent in high-carbon steels having the processing strain of 3 or greater, thus the ductility is likely to be decreased. Here, in order to attain the expected effect(s), it is suitable to relax the strain aging occurred during processing by using a straightening processing, shot-peening treatment, skin-pass drawing, and the like immediately after processing.

Further, in the present invention, the tensile strength of metal wire material of the high-carbon steel is 3,000 MPa or greater, preferably 4,000 MPa or greater. The ductility of this metal wire material having a tensile strength of 4,000 MPa or greater is likely to be prominently decreased by delamination and the like, therefore, it is advantageous to apply the heat treatment according to the present invention to such a wire material to increase the ductility thereof.

The above-described metal wire material can be obtained by a known method and the production method such as drawing should not be particularly limited.

In the present invention, a heat treatment is performed on the above-described metal wire material at a temperature range of 90-300° C. As described above, this temperature range is a secondary exothermic reaction and it is crucial that the relationship between the heat treatment time t(s) and heat treatment temperature T(K), represented by the following equation:

$$0.1\leq \mathrm{Ln}(t)-10100/T+20\leq 11 \quad (1)$$

preferably, the following equation:

$$5\leq \mathrm{Ln}(t)-10100/T+20\leq 10 \quad (2)$$

be satisfied. Further, as for the heat treatment time, 3 minutes (180 s) or longer is preferable so that heat is applied uniformly, and 50 hours (180 ks) or shorter is preferred as the productivity decreases in a heat treatment carried out over a prolonged period of time.

When the above-described relationship is satisfied, spheroidization of cementite hardly occurs and although there is no elongation recovery, the tenacity hardly decreases and by strain aging relaxation, the torsional property, bending property, and fatigue resistance are improved. Further, as the heat treatment is performed at a low temperature of 90-300° C., formation of oxide film such as bluing is hardly observed.

Further, in the present invention, it is preferred that a heat treatment on metal wire material be carried out in a reduced pressure or inert gas. In cases where the heat treatment is carried out in the air, the surface of metal wire material is oxidized, and for example, when the metal wire material whose surface is oxidized is used as reinforcement for a rubber product such as a tire and the like, the adhesiveness to rubber may be impaired. The oxide coated on the metal wire material may be removed as well; however, it is effective to carry out the heat treatment in a vacuum or inert gas in which suppress the oxidation of the surface of the metal wire material, rather than adding the removal process to the steps of the production process of the metal wire material.

EXAMPLE

Hereinafter, the present invention will be explained by way of examples.

(Effects of Heat Treatment on Metal Wire Material)

A heat treatment was performed on a metal wire material of high-carbon steel having 1.0% by mass of carbon atom content, processing strain of 3.8, and tensile strength of 4,200 MPa (hereinafter, referred to as "sample metal wire material 1") to measure the reaction heat of the metal wire material at each temperature, the strength (tensile strength), and the ductility strength.

The reaction heat of the metal wire material at each temperature was determined based on a differential scanning calorimeter (DSC). Further, the strength of the metal wire material after the heat treatment was evaluated as the value determined by constructing a stress-strain curve based on the tensile test according to JIS Z 2241, from which curve the maximum stress was determined. Further, the ductility strength after the heat treatment was determined based on the method of calculating loop strength retention rate described in Japanese Unexamined Patent Application Publication No. H6-184963.

From the thus obtained reaction heat curve, there were confirmed three exothermic reactions at 90° C. (the first), 90-250° C. (the second), and 250-400° C. (the third). Further, it was discovered that the ductility strength decreases while the strength is high in the first reaction, that the strength decreases slightly while the ductility strength is improved in the second reaction, and that both the strength and ductility strength decrease in the third reaction.

(Relationship Between Heat Treatment and Bending Property)

Next, the relationship between heat treatment and bending property was determined. The bending property was determined for sample metal wire material 1 and sample metal wire material 2 (0.9% by mass of carbon atom content, processing strain of 4.2, tensile strength of 4,400 MPa), which have a diameter of 0.22 mmϕ based on the method of calculating loop strength retention rate described in Japanese Unexamined Patent Application Publication No. H6-184963 and represented as indices, taking the condition of the metal wire material as it is without heat treatment as 100. A larger value indicates better bending property.

Further, the values of the equation representing the relationship between the heat treatment time t(s) and the heat treatment temperature T(K), in the exothermic reaction zone of the second reaction: Ln(t)−10100/T+20, were used as the heat treatment indices. As a result, as illustrated in FIG. 1, it was discovered that, for both the sample metal wire material 1 and sample metal wire material 2, only strain aging occurs and the bending property is decreased in cases where the above-described value is less than 0.1, and that even in cases where the value exceeds 11, the bending property also decreases due to the occurrence of fragmentation (spheroidization) reaction of cementite.

The invention claimed is:

1. A method of producing a metal wire material, wherein when a heat treatment is performed at a temperature range of 90-250° C. on a metal wire material of high-carbon steel containing 0.5-1.1% by mass of carbon atoms and having a processing strain of 2.5 or greater and tensile strength of 4,000 MPa or greater, a relationship between heat treatment time t(s) and heat treatment temperature T(K) at said temperature range represented by the following equation:

$$7.5 \leq \mathrm{Ln}(t) - 10100/T + 20 \leq 10$$

is satisfied.

2. The method of producing a metal wire material according to claim 1, wherein said heat treatment is carried out in a vacuum or inert gas.

3. The method of producing a metal wire material according to claim 1, wherein said metal wire has a tensile strength of no more than 4,600 MPa.

4. The method of producing a metal wire material according to claim 1, wherein said metal wire has a tensile strength of 4,200 MPa or greater.

5. The method of producing a metal wire material according to claim 1, wherein said metal wire has a tensile strength of no more than 4,400 MPa.

6. The method of producing a metal wire material according to claim 4, wherein said metal wire has a tensile strength of no more than 4,400 MPa.

* * * * *